US011551630B2

(12) United States Patent
Hu et al.

(10) Patent No.: US 11,551,630 B2
(45) Date of Patent: Jan. 10, 2023

(54) APPARATUS AND METHOD FOR CONTROLLING DISPLAY MODULE AND DISPLAY DEVICE

(71) Applicants: Hefei BOE Optoelectronics Technology Co., Ltd., Anhui (CN); BOE Technology Group Co., Ltd., Beijing (CN)

(72) Inventors: Lingxiao Hu, Beijing (CN); Ruwen Tang, Beijing (CN); Xiang Wang, Beijing (CN); Jiawei Wu, Beijing (CN); Bowen Qu, Beijing (CN)

(73) Assignees: HEFEI BOE OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 239 days.

(21) Appl. No.: 16/831,914

(22) Filed: Mar. 27, 2020

(65) Prior Publication Data

US 2021/0142757 A1 May 13, 2021

(30) Foreign Application Priority Data

Nov. 7, 2019 (CN) ..... 201911084007.5

(51) Int. Cl.
*G09G 3/36* (2006.01)

(52) U.S. Cl.
CPC ..... *G09G 3/3696* (2013.01); *G09G 3/3688* (2013.01); *G09G 2310/0294* (2013.01); *G09G 2340/00* (2013.01)

(58) Field of Classification Search
CPC .. G09G 3/3696; G09G 3/3688; G09G 3/3655; G09G 3/3614; G09G 2380/16;
(Continued)

(56) References Cited

U.S. PATENT DOCUMENTS 10,147,386 B1 12/2018 Wang
10,535,315 B2 1/2020 Park et al.
(Continued)

FOREIGN PATENT DOCUMENTS

CN 101206319 A 6/2008
CN 104517583 A 4/2015
(Continued)

OTHER PUBLICATIONS

First office action of Chinese application No. 201911084007.5 dated Feb. 10, 2021.

*Primary Examiner* — Christopher E Leiby
(74) *Attorney, Agent, or Firm* — Fay Sharpe LLP

(57) ABSTRACT

The present disclosure provides an apparatus and method for controlling a display module, and a display device. The apparatus for controlling the display module includes a voltage sampling circuit and a data processing circuit. The voltage sampling circuit may acquire a data voltage and a common voltage and transmit the acquired data voltage and common voltage to the data processing circuit. The data processing circuit may determine, based on the data voltage and the common voltage, whether liquid crystal molecules are deflected abnormally, and control a main control circuit to restart if the liquid crystal molecules are deflected abnormally.

18 Claims, 9 Drawing Sheets

(58) Field of Classification Search
CPC ..... G09G 2310/0294; G09G 2330/12; G09G 2330/026; G09G 2340/00
See application file for complete search history.

(56) References Cited

U.S. PATENT DOCUMENTS

| | | | | |
|---|---|---|---|---|
| 2008/0030445 | A1 | 2/2008 | Choi et al. | |
| 2009/0128527 | A1* | 5/2009 | Itakura | G09G 3/3688 345/205 |
| 2009/0147164 | A1* | 6/2009 | Toyoshima | H04N 5/70 349/39 |
| 2010/0149151 | A1* | 6/2010 | Nam | G09G 3/3614 345/92 |
| 2010/0207918 | A1* | 8/2010 | Lee | G09G 3/3614 345/96 |
| 2016/0275837 | A1* | 9/2016 | Toyoshima | G09G 3/3655 |

FOREIGN PATENT DOCUMENTS

| | | | |
|---|---|---|---|
| CN | 106023922 | A | 10/2016 |
| JP | 6419895 | B2 | 11/2018 |
| KR | 20110030215 | A | 3/2011 |

* cited by examiner

APPARATUS AND METHOD FOR CONTROLLING DISPLAY MODULE AND DISPLAY DEVICE

This application claims priority to Chinese Patent Application No. 201911084007.5, filed on Nov. 7, 2019 and entitled "APPARATUS AND METHOD FOR CONTROLLING DISPLAY MODULE AND DISPLAY DEVICE", the entire contents of which are incorporated herein by reference.

TECHNICAL FIELD

The present disclosure relates to the field of display technology, and more particularly to an apparatus and method for controlling a display module, and a display device.

BACKGROUND

Owing to advantages of high resolution, light weight, low energy consumption, and the like, a liquid crystal display (LCD) panel is widely used in the display field.

Each pixel in the LCD panel includes a pixel electrode, a common electrode, and liquid crystal molecules. By applying a data voltage to the pixel electrode and a common voltage to the common electrode, the liquid crystal molecules are deflected under the effect of the data voltage and the common voltage to realize light transmission. However, if data voltages with the same polarity are applied to the pixel electrode for a long time, the liquid crystal molecules may be polarized (that is, a relatively lower deflection speed and a relatively smaller deflection amplitude may be caused).

SUMMARY

The present disclosure provides an apparatus and method for controlling a display module, and a display device. The technical solutions are as follows:

In one aspect, an apparatus for controlling a display module is provided. The display module includes a display panel, a main control circuit, a source driving circuit, and a common voltage supply circuit; and the apparatus includes a voltage sampling circuit and a data processing circuit.

The voltage sampling circuit is connected to the source driving circuit, the common voltage supply circuit, and the data processing circuit respectively, and configured to acquire a data voltage supplied by the source driving circuit, and a common voltage supplied by the common voltage supply circuit, and transmit the data voltage and the common voltage to the data processing circuit.

The data processing circuit is further connected to the main control circuit, and configured to determine, based on the data voltage and the common voltage, whether liquid crystal molecules in the display panel are deflected abnormally, and output a restart signal to the main control circuit if the liquid crystal molecules in the display panel are deflected abnormally, wherein the restart signal is intended to instruct the main control circuit to restart.

Optionally, the voltage sampling circuit includes a data voltage sampling sub-circuit and a common voltage sampling sub-circuit, wherein the data voltage sampling sub-circuit is connected to the source driving circuit and the data processing sub-circuit respectively, and configured to acquire, at a first time instant, a first data voltage supplied by the source driving circuit, to acquire, at a second time instant, a second data voltage supplied by the source driving circuit, and transmit the first data voltage and the second data voltage to the data processing sub-circuit, wherein the first data voltage and the second data voltage have opposite polarities; and the common voltage sampling sub-circuit is connected to the common voltage supply circuit and the data processing sub-circuit respectively, and configured to acquire, at the first time instant, a first common voltage supplied by the common voltage supply circuit, acquire, at the second time instant, a second common voltage supplied by the common voltage supply circuit; and transmit the first common voltage and the second common voltage to the data processing sub-circuit.

Optionally, the data processing circuit includes a data processing sub-circuit and a determining sub-circuit.

The data processing sub-circuit is further connected to the determining sub-circuit, and configured to determine a first difference between the first data voltage and the first common voltage and a second difference between the second data voltage and the second common voltage, and transmit the first difference and the second difference to the determining sub-circuit.

The determining sub-circuit is configured to determine, based on the first difference and the second difference, whether the liquid crystal molecules in the display panel are deflected abnormally.

Optionally, the determining sub-circuit is configured to:

determine the difference between the first difference and the second difference;

determine that the liquid crystal molecules in the display panel are deflected abnormally if a difference between the first difference and the second difference is greater than a difference threshold; and determine that the liquid crystal molecules in the display panel are deflected normally if the difference between the first difference and the second difference is less than or equal to the difference threshold.

Optionally, the voltage sampling circuit is configured to acquire, based on a target sampling frequency, a data voltage supplied by the source driving circuit and a common voltage supplied by the common voltage supply circuit, wherein the target sampling frequency is less than or equal to a polarity reversal frequency of the data voltage.

Optionally, the data processing circuit is further connected to the common voltage supply circuit.

The voltage sampling circuit is further configured to acquire, after the main control circuit is restarted, a data voltage supplied by the source driving circuit and a common voltage supplied by the common voltage supply circuit, and transmit the data voltage and the common voltage that are acquired after the main control circuit is restarted to the data processing circuit.

The data processing circuit is further configured to determine again, based on the data voltage and the common voltage that are acquired after the main control circuit is restarted, whether the liquid crystal molecules in the display panel are deflected abnormally, and output an inactive enable signal to the common voltage supply circuit the liquid crystal molecules in the display panel are deflected abnormally, wherein the inactive enable signal is intended to instruct the common voltage supply circuit to stop supplying a common voltage.

Optionally, the data processing circuit is further configured to output a shutdown signal to the main control circuit if it is determined again that the liquid crystal molecules in the display panel are deflected abnormally, wherein the shutdown signal is intended to instruct the main control circuit to be shut down.

Optionally, the data processing circuit is further configured to record restart information of the main control circuit after outputting the restart signal to the main control circuit.

Optionally, both of the voltage sampling circuit and the data processing circuit are processing chips.

In another aspect, a method for controlling a display module is provided. The display module includes a display panel, a main control circuit, a source driving circuit, and a common voltage supply circuit; and the method includes:

acquiring a data voltage supplied by the source driving circuit, and a common voltage supplied by the common voltage supply circuit;

determining, based on the data voltage and the common voltage, whether liquid crystal molecules in the display panel are deflected abnormally; and outputting a restart signal to the main control circuit if it is determined that the liquid crystal molecules in the display panel are deflected abnormally; wherein the restart signal is intended to instruct the main control circuit to restart.

Optionally, acquiring the data voltage supplied by the source driving circuit, and the common voltage supplied by the common voltage supply circuit includes:

acquiring, at a first time instant, a first data voltage supplied by the source driving circuit and a first common voltage supplied by the common voltage supply circuit; and acquiring, at a second time instant, a second data voltage supplied by the source driving circuit and a second common voltage supplied by the common voltage supply circuit; wherein the first data voltage and the second data voltage have opposite polarities; and determining, based on the data voltage and the common voltage, whether the liquid crystal molecules in the display panel are deflected abnormally includes:

determining a first difference between the first data voltage and the first common voltage and a second difference between the second data voltage and the second common voltage; and determining, based on the first difference and the second difference, whether the liquid crystal molecules in the display panel are deflected abnormally.

Optionally, determining, based on the first difference and the second difference, whether the liquid crystal molecules in the display panel are deflected abnormally includes:

determining the difference between the first difference and the second difference; and determining that the liquid crystal molecules in the display panel are deflected abnormally if a difference between the first difference and the second difference is greater than a difference threshold; or determining that the liquid crystal molecules in the display panel are deflected normally if the difference between the first difference and the second difference is less than or equal to the difference threshold.

Optionally, acquiring the data voltage supplied by the source driving circuit, and the common voltage supplied by the common voltage supply circuit includes:

acquiring, based on a target sampling frequency, a data voltage supplied by the source driving circuit and a common voltage supplied by the common voltage supply circuit; wherein the target sampling frequency is less than or equal to a polarity reversal frequency of the data voltage.

Optionally, after outputting the restart signal to the main control circuit, the method further includes:

acquiring, after the main control circuit is restarted, a data voltage supplied by the source driving circuit and a common voltage supplied by the common voltage supply circuit;

determining again, based on the acquired data voltage and common voltage after the main control circuit is restarted, whether the liquid crystal molecules in the display panel are deflected abnormally; and outputting an inactive enable signal to the common voltage supply circuit if it is determined again that the liquid crystal molecules in the display panel are deflected abnormally, wherein the inactive enable signal is intended to instruct the common voltage supply circuit to stop supplying a common voltage.

Optionally, after determining again that the liquid crystal molecules in the display panel are deflected abnormally, the method further includes:

outputting a shutdown signal to the main control circuit if it is determined again that the liquid crystal molecules in the display panel are deflected abnormally, wherein the shutdown signal is intended to instruct the main control circuit to be shut down.

Optionally, after outputting the restart signal to the main control circuit, the method further includes: recording restart information of the main control circuit.

In another aspect, a display device is provided. The display device includes a display module and the apparatus for controlling the display module as defined in the foregoing aspect. The apparatus for controlling the display module is connected to the display module.

In yet another aspect, an apparatus for use in controlling a display module is provided. The apparatus includes a processor and a memory. The memory stores at least one instruction therein, which, when being loaded and executed by the processor, enables the processor to perform the method for controlling the display module as defined in the above aspect.

In yet another aspect, a non-volatile storage medium is provided. The non-volatile storage medium stores at least one instruction therein. When the non-volatile storage medium runs on a processor, the processor is enabled to perform the method for controlling the display module as defined in the above aspect.

BRIEF DESCRIPTION OF THE DRAWINGS

In order to describe the technical solutions in the embodiments of the present more clearly, the following briefly introduces the accompanying drawings required for describing the embodiments. Apparently, the accompanying drawings in the following description show merely some embodiments of the present disclosure, and a person of ordinary skill in the art may also derive other drawings from these accompanying drawings without creative efforts.

DETAILED DESCRIPTION

For dearer descriptions of the objects, technical solutions, and advantages in the present disclosure, the present disclosure is described in detail below in combination with the accompanying drawings.

In the related art, for an LCD panel, in order to prevent liquid crystal molecules from being polarized, which is caused by applying a data voltage with a fixed polarity to a pixel electrode for a long time, the polarity of the data voltage may be controlled to be constantly reversed.

Figure 1:
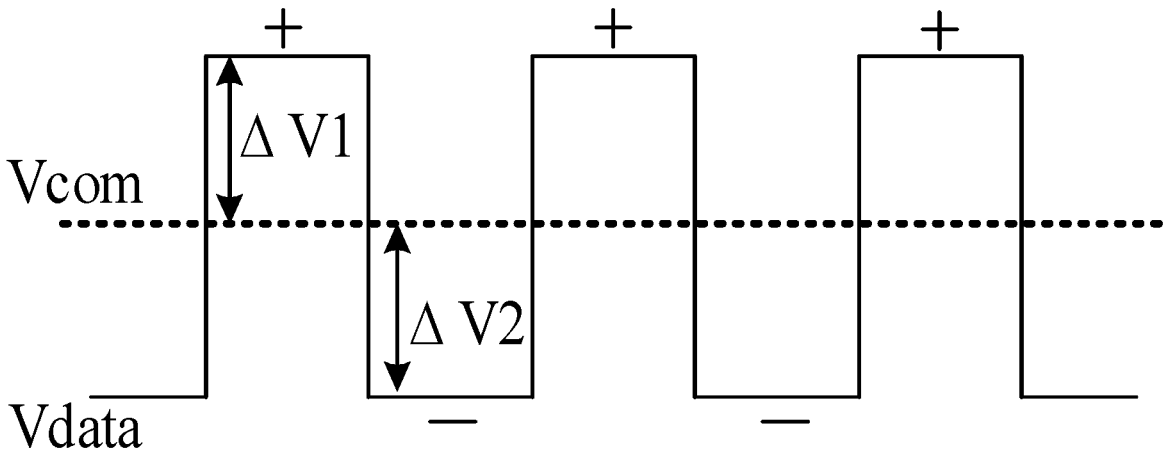
FIG. 1 is a schematic diagram of a data voltage and a common voltage in accordance with an embodiment of the present disclosure.

For example, FIG. 1 is a schematic diagram of a data voltage and a common voltage. It may be seen with reference to FIG. 1 that the data voltage Vdata applied to the pixel electrode is periodically and constantly changed between a positive polarity and a negative polarity. Furthermore, when circuits that drive the display panel to operate (such as a main control circuit that provides the data voltage or a rear-end circuit of the display panel) function normally, referring to FIG. 1, a relative difference ΔV1 between the data voltage Vdata with the positive polarity and the common voltage Vcom is approximate to a relative difference ΔV2 between the data voltage Vdata with the negative polarity and the common voltage Vcom, wherein the term "approximate" means that ΔV1 and ΔV2 are equal or have a tiny difference.

Figure 2:
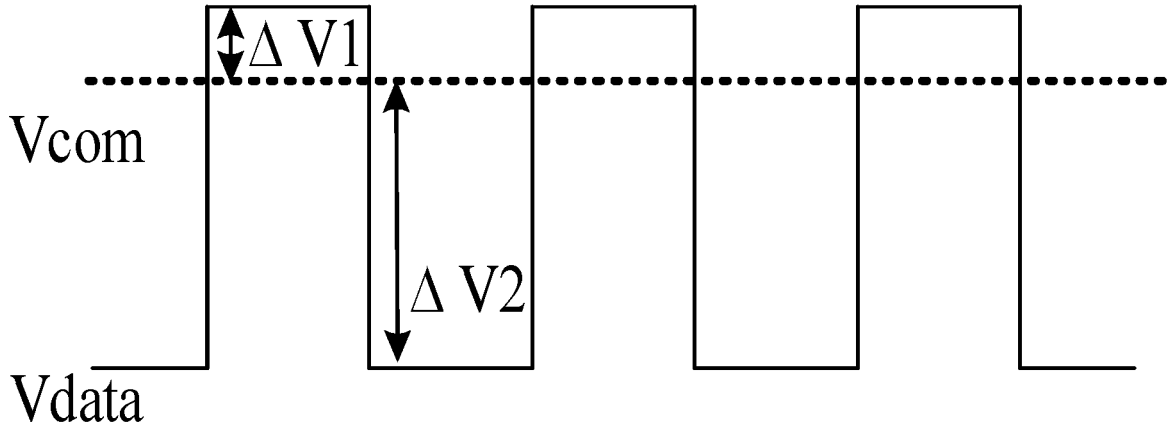
FIG. 2 is a schematic diagram of another data voltage and another common voltage in accordance with an embodiment of the present disclosure.
Figure 3:
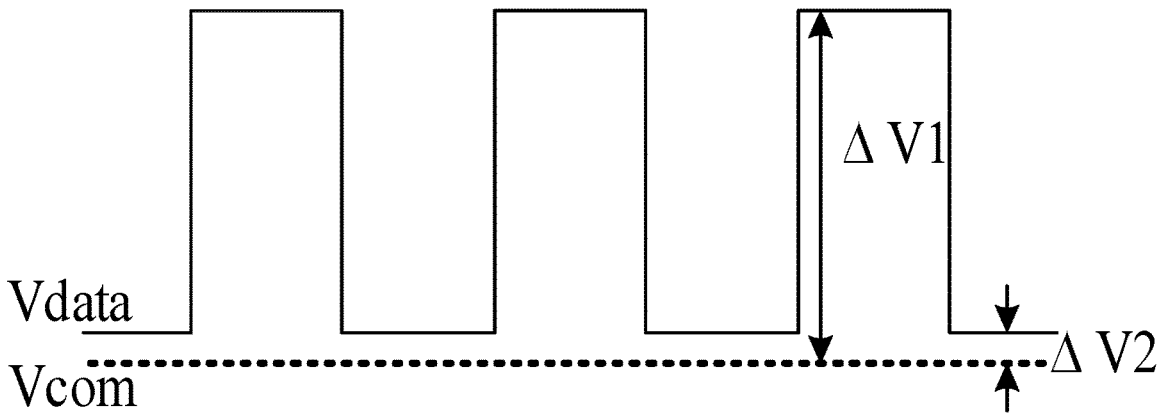
FIG. 3 is a schematic diagram of still another data voltage and still another common voltage in accordance with an embodiment of the present disclosure.

However, when an abnormality occurs to a circuit that drives the display panel to work, a big difference between the relative difference ΔV1 and the relative difference ΔV2 may be caused. For example, FIG. 2 is a schematic diagram of another data voltage and another common voltage, and FIG. 3 is a schematic diagram of still another data voltage and still another common voltage. Referring to FIG. 2, the relative difference ΔV1 is much less than the relative difference ΔV2. Referring to FIG. 3, the relative difference ΔV1 is much greater than the relative difference ΔV2.

The liquid crystal molecules may be deflected abnormally when the relative difference ΔV1 and the relative difference ΔV2 are quite different. If the display panel operates in this state for a long time, the liquid crystal molecules may be polarized due to circuit abnormalities. Moreover, through test and research, if the abnormal state occurs in a high-temperature environment, the liquid crystal molecules may be polarized more severely, and after the display panel stops operating (e.g., power off), the liquid crystal molecules may not return to normal condition for a long time. At this time, it may be necessary to perform a high-temperature uncharged aging test on the display panel, and the liquid crystal molecules may not return to the normal condition after the abnormalities are eliminated by the tests.

Figure 4:
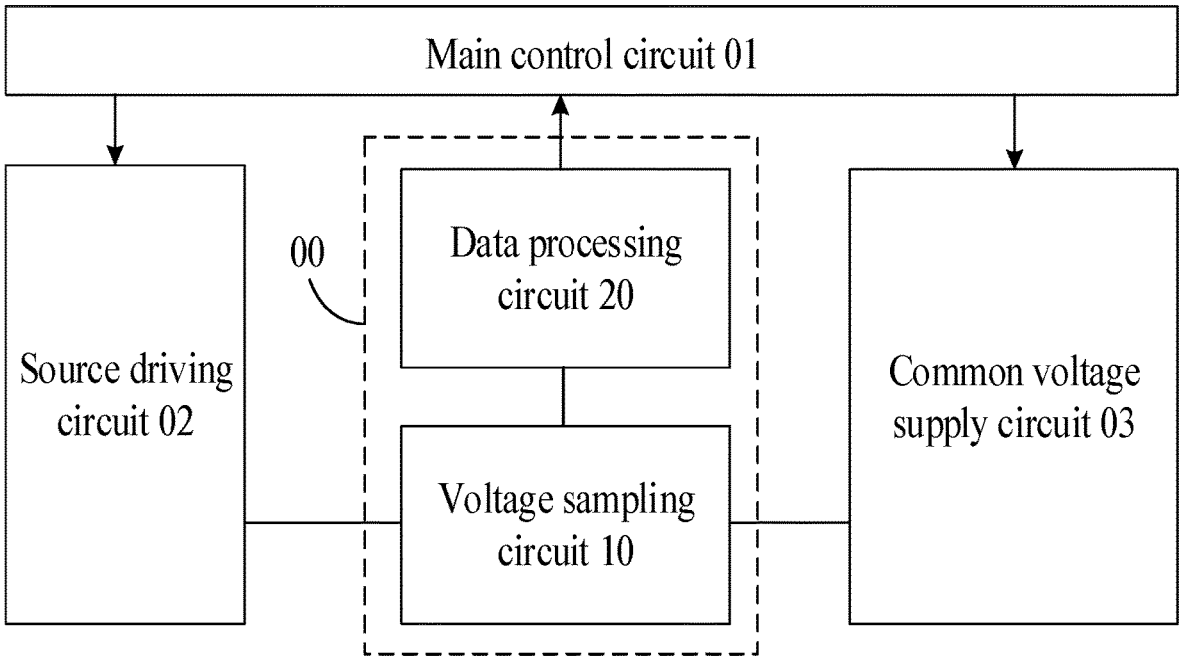
FIG. 4 is a schematic structural diagram of an apparatus for controlling a display module in accordance with an embodiment of the present disclosure.

An embodiment of the present disclosure provides an apparatus for controlling a display module, which may solve the problem that liquid crystal molecules are polarized due to circuit abnormalities. FIG. 4 is a schematic structural diagram of an apparatus for controlling a display module in accordance with an embodiment of the present disclosure. As shown in FIG. 4, the display module may include a display panel (not shown in FIG. 4), a main control circuit 01, a source driving circuit 02, and a common voltage supply circuit 03. The device 00 may include a voltage sampling circuit 10 and a data processing circuit 20.

The voltage sampling circuit 10 may be connected to the source driving circuit 02, the common voltage supply circuit 03, and the data processing circuit 20 respectively, and may acquire a data voltage supplied by the source driving circuit 02 and a common voltage supplied by the common voltage supply circuit 03 and transmit the data voltage and the common voltage to the data processing circuit 20.

The data processing circuit 20 may be further connected to the main control circuit 01, and may determine, based on the received data voltage and common voltage, whether liquid crystal molecules in the display panel are deflected abnormally, and output a restart signal to the main control circuit 01 if the liquid crystal molecules are deflected abnormally. The restart signal is intended to instruct the main control circuit 01 to restart.

In summary, this embodiment provides an apparatus for controlling the display module. The apparatus includes a voltage sampling circuit and a data processing circuit. The voltage sampling circuit may acquire the data voltage and the common voltage, and transmit the acquired data voltage and common voltage to the data processing circuit. The data processing circuit may determine, based on the data voltage and the common voltage, whether the liquid crystal molecules are deflected abnormally, and control the main control circuit to restart if the liquid crystal molecules are deflected abnormally. Since the main control circuit may return to the normal condition by restart if abnormal deflection is caused by an abnormality of the main control circuit, abnormal polarity reversal caused by a transient abnormality of the main control circuit may be reliably avoided. Further, the liquid crystal molecules may be prevented from being polarized after continuously operating in the situation of abnormal deflection.

Optionally, referring to FIG. 1, the main control circuit 01 may be further connected to the source driving circuit 02 and the common voltage supply circuit 03 respectively. The main control circuit 01 may output a data signal to the source driving circuit 02, and may also output a power signal to the common voltage supply circuit 03. The main control circuit 01 may be referred to as a system of a display device.

The source driving circuit 02 may be further connected to a data line in the display panel, and may output a data voltage Vdata to the connected data line in response to the received data signal. The common voltage supply circuit 03 may be further connected to a common electrode line in the display panel, and may output a common voltage Vcom to the connected common electrode line in response to the received power signal. The voltage sampling circuit 10 acquires the data voltage output from the source driving circuit 02 to the data line, and the common voltage output from the common voltage supply circuit 03 to the common electrode line.

It should be noted that a target sampling frequency may be preset in the voltage sampling circuit 10, and the voltage sampling circuit 10 may acquire the data voltage and the common voltage based on the target sampling frequency. In order to ensure that the data voltages acquired every two adjacent times have opposite polarities, the target sampling frequency may be less than or equal to a polarity reversal frequency of the data voltage. For example, the target sampling frequency may be equal to the polarity reversal frequency of the data voltage.

Figure 5:
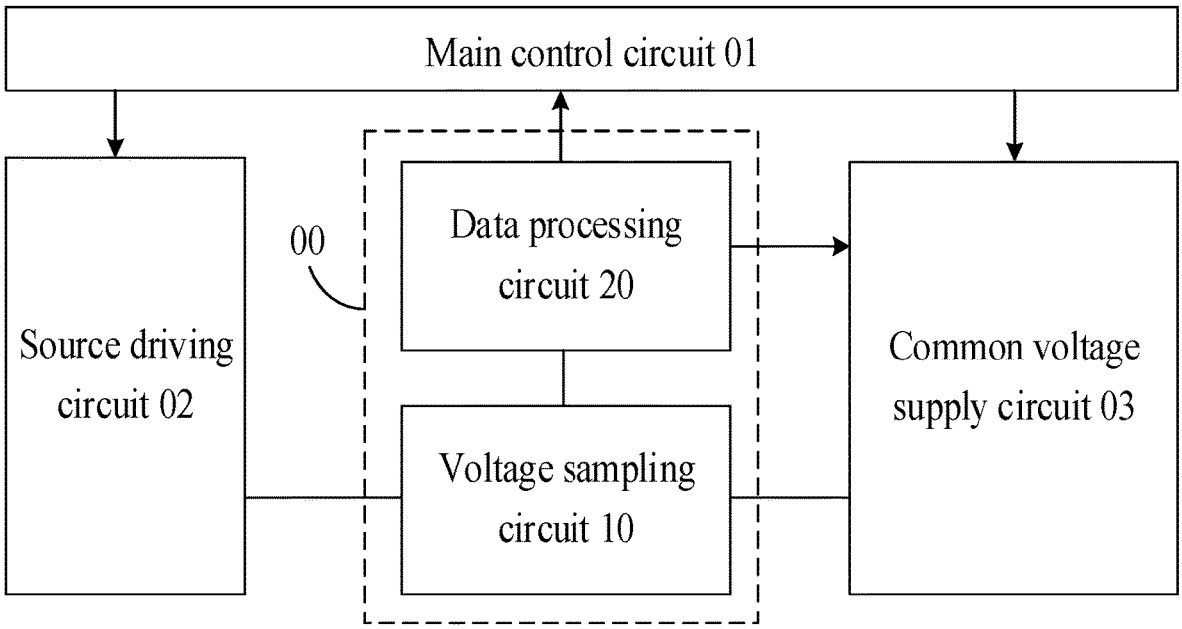
FIG. 5 is a schematic structural diagram of another apparatus for controlling a display module in accordance with an embodiment of the present disclosure.

Optionally, FIG. 5 is a schematic structural diagram of another apparatus for controlling a display module in accordance with an embodiment of the present disclosure. As shown in FIG. 5, the data processing circuit 20 may also be connected to the common voltage supply circuit 03.

The voltage sampling circuit 10 may further reacquire, after the main control circuit 01 is restarted, a data voltage supplied by the source driving circuit 02 and a common voltage supplied by the common voltage supply circuit 03, and transmit the reacquired data voltage and common voltage to the data processing circuit 20.

The data processing circuit 20 may determine again, based on the data voltage and the common voltage that are reacquired by the voltage sampling circuit 10, whether the liquid crystal molecules in the display panel are deflected abnormally, and further output an inactive enable signal to the common voltage supply circuit 03 if the liquid crystal molecules are deflected abnormally. The inactive enable signal may be intended to instruct the common voltage supply circuit 03 to stop supplying a common voltage. The display panel may stop operating (e.g., a black screen) when the common voltage supply circuit 03 stops supplying the common voltage.

Since the liquid crystal molecules are still deflected abnormally after the main control circuit 01 is restarted, the abnormal deflection may be caused by abnormalities of the rear-end circuit components of the display panel. Therefore, by reacquiring the data voltage and the common voltage after the main control circuit 01 is restarted, and controlling the common voltage supply circuit 03 to stop supplying the common voltage (i.e., controlling the display panel to stop operating) when it is determined, based on the reacquired data voltage and common voltage, that the liquid crystal molecules are deflected abnormally, the liquid crystal molecules may be further effectively prevented from being polarized after continuously operating in in the situation of abnormal deflection.

It should be noted that the data processing circuit 20 may control, when it is determined again that the liquid crystal molecules are deflected abnormally, other circuits capable of stopping the display panel from operating to stop outputs. For example, if the data processing circuit 20 determines again, after the main control circuit 01 is restarted, that the liquid crystal molecules are deflected abnormally, the data processing circuit 20 may directly control the main control circuit 01 to stop outputting (i.e., to control the main control circuit 01 to be shut down). In addition, the data processing circuit 20 may also directly control the display panel to stop operating when it is determined for the first time that the liquid crystal molecules are deflected abnormally.

Figure 6:
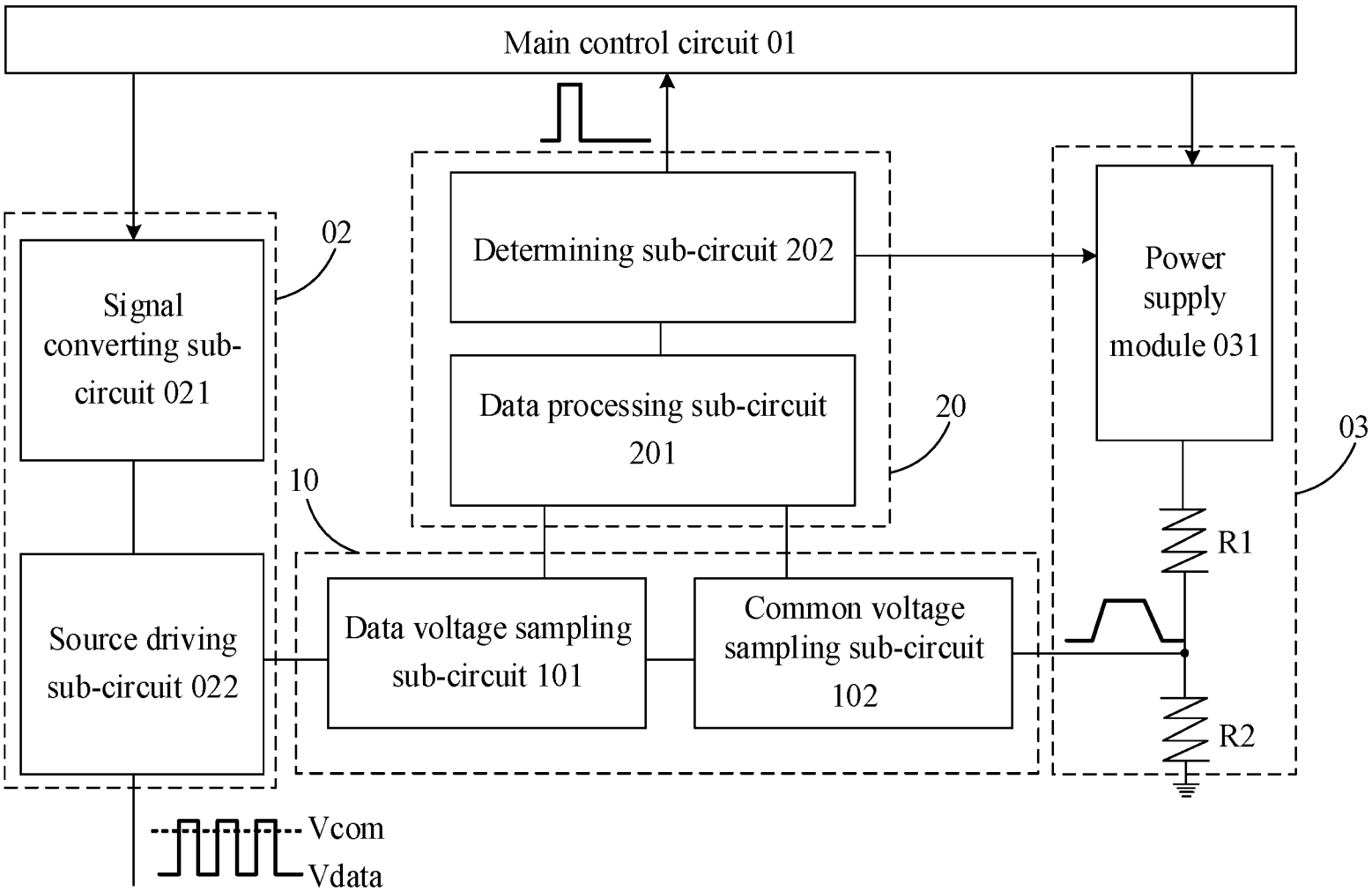
FIG. 6 is a schematic structural diagram of still another apparatus for controlling a display module in accordance with an embodiment of the present disclosure.

FIG. 6 is a schematic structural diagram of still another apparatus for controlling a display module in accordance with an embodiment of the present disclosure. As shown in FIG. 6, the voltage sampling circuit 10 may include a data voltage sampling sub-circuit 101 and a common voltage sampling sub-circuit 102, and the data processing circuit 20 may include a data processing sub-circuit 201 and a determining sub-circuit 202.

The data voltage sampling sub-circuit 101 may be connected to the source driving circuit 02 and the data processing sub-circuit 201 respectively, and configured to acquire, at a first time instant, a first data voltage supplied by the source driving circuit 02, to acquire, at a second time instant, a second data voltage supplied by the source driving circuit 02, and transmit the first data voltage and the second data voltage to the data processing sub-circuit 201.

The first data voltage and the second data voltage have opposite polarities. For example, the polarity of the second data voltage is negative if the polarity of the first data voltage is positive. Correspondingly, an interval between the first time instant and the second time instant needs to satisfy certain conditions, such that the data voltages acquired by the data voltage sampling sub-circuit 101 at these two moments have exactly opposite polarities. The interval between the first time instant and the second time instant is the reciprocal of the target sampling frequency.

The common voltage sampling sub-circuit 102 may be connected to the common voltage supply circuit 03 and the data processing sub-circuit 201 respectively, and configured to acquire, at the first time instant, a first common voltage supplied by the common voltage supply circuit 03, to acquire, at the second time instant, a second common voltage supplied by the common voltage supply circuit 03, and transmit the first common voltage and the second common voltage to the data processing sub-circuit 201.

It should be noted that to guarantee that the data voltage sampling sub-circuit 101 and the common voltage sampling sub-circuit 102 may collect the voltages at the same time, referring to FIG. 6, the data voltage sampling sub-circuit 101 and the common voltage sampling sub-circuit 102 may be connected to each other and may work synchronously under the control of a preset synchronizing signal. That is, the data voltage sampling sub-circuit 101 and the common voltage sampling sub-circuit 102 may sample the voltages based on the same target sampling frequency.

The data processing sub-circuit 201 may also be connected to the determining sub-circuit 202. The data processing sub-circuit 201 may determine a first difference between the first data voltage and the first common voltage and a second difference between the second data voltage and the second common voltage, and transmit the first difference and the second difference to the determining sub-circuit 202. The first difference is a value obtained by subtracting the first common voltage from the first data voltage, and the second difference is a value obtained by subtracting the second common voltage from the second data voltage.

The determining sub-circuit 202 may determine, based on the received first difference and second difference, whether the liquid crystal molecules in the display panel are deflected abnormally.

In this embodiment, the determining sub-circuit 202 may determine a difference between the first difference and the second difference. If the difference between the first difference and the second difference is greater than a difference threshold, the determining sub-circuit 202 may determine that the liquid crystal molecules in the display panel are deflected abnormally, and if the difference between the first difference and the second difference is less than or equal to the difference threshold, the determining sub-circuit 202 may determine that the liquid crystal molecules in the display panel are deflected normally. The difference between the first difference and the second difference may be a value obtained by subtracting a smaller value from a larger value of the first difference and the second difference, or the absolute value of the difference between the first difference and the second difference.

Optionally, the difference threshold may be a fixed value preset in the determining sub-circuit 202. With reference to FIG. 1, since the smaller the difference between the first difference and the second difference is, the better it is, the difference threshold may be relatively small. For example, the difference threshold may be 0. Correspondingly, assuming that the first difference is $\Delta V1$ and the second difference is $\Delta V2$, the determining sub-circuit 202 may determine that the liquid crystal molecules are deflected normally only when it determines that $\Delta V1=\Delta V2$. It may be determined that the liquid crystal molecules are deflected abnormally when it is determined that $\Delta V1\neq\Delta V2$.

Optionally, referring to FIG. 6, the data processing circuit 20 may be connected to the main control circuit 01 and the common voltage supply circuit 03 by the determining sub-circuit 202.

The determining sub-circuit 202 may output a restart signal, which is intended to instruct the main control circuit 01 to restart, to the main control circuit 01 when determining for the first time (before the main control circuit 01 is restarted) that the liquid crystal molecules are deflected abnormally, so as to control the main control circuit 01 to restart. For example, referring to FIG. 6, it is assumed that the main control circuit 01 may work normally when a potential of the signal output from the determining sub-circuit 202 to the main control circuit 01 is a first potential. At this time, the determining sub-circuit 202 may adjust the potential of the signal from the first potential to a second potential, such that the main control circuit 01 is restarted. Optionally, the first potential may be a low potential relative to the second potential.

The determining sub-circuit 202 may output an inactive enable signal, which is intended to instruct the common voltage supply circuit 03 to stop supplying a common voltage, to the common voltage supply circuit 03 when determining for the second time (after the main control circuit 01 is restarted) that the liquid crystal molecules are deflected abnormally, so as to control the common voltage supply circuit 03 to stop outputting. For example, referring to FIG. 7, it is assumed that the common voltage supply circuit 03 may output normally when a potential of the signal output from the determining sub-circuit 202 to the common voltage supply circuit 03 is the second potential. At this time, the determining sub-circuit 202 may adjust the potential of the signal from the second potential to the first potential, such that the common voltage supply circuit 03 stops outputting.

In this embodiment, the data processing circuit 20 may further record the restart information of the main control circuit 01 after outputting the restart signal to the main control circuit 01. Optionally, the restart information may include restart time and a restart reason. Alternatively, the restart information may also be automatically recorded by the main control circuit 01. By recording the restart information, it is convenient for a worker to locate the causes to the abnormal deflection of the liquid crystal molecules with a follow-up reference to the restart information, such that the causes of the abnormality are quickly identified.

Optionally, both of the voltage sampling circuit 10 and the data processing circuit 20 may be processing chips. The device 00 may be integrated in a timing controller (Icon) in the display module, or disposed independently of the display module.

Figure 7:
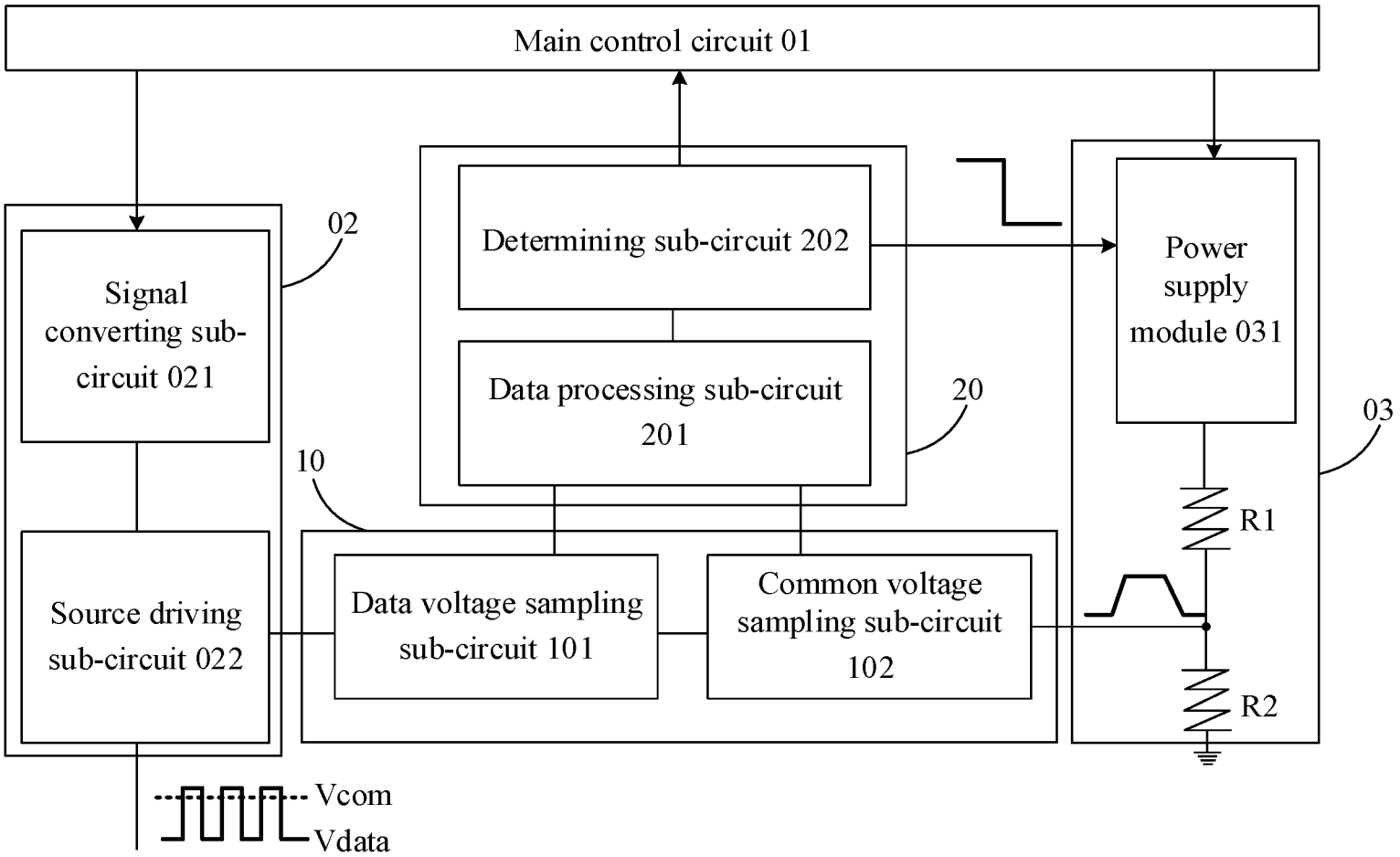
FIG. 7 is a schematic structural diagram of yet still another apparatus for controlling a display module in accordance with an embodiment of the present disclosure.

Optionally, referring to FIGS. 6 and 7, the source driving circuit 02 may include a signal converting sub-circuit 021 and a source driving sub-circuit 022.

The signal converting sub-circuit 021 may be connected to the main control circuit 01 and the source driving sub-circuit 022 respectively, receive a data signal supplied by the main control circuit 01, convert the data signal into a data voltage, and then, output the data voltage to the source driving sub-circuit 022.

The source driving sub-circuit 022 may also be connected to a data line in the display panel and the data voltage sampling sub-circuit 101, and may output the data voltage to the data line. Correspondingly, the data voltage sampling sub-circuit 101 may acquire the data voltage output from the source driving sub-circuit 022 to the data line.

Optionally, referring to FIGS. 6 and 7, the common voltage supply circuit 03 may include a power supply module 031, a first resistor R1, and a second resistor R2.

The power supply module 031 may be connected to the determining sub-circuit 202, the main control circuit 01, and one end of the first resistor R1 respectively. The other end of the first resistor may be connected to one end of the second resistor R2. The other end of the second resistor R2 may be connected to the ground. A connection point of the first resistor R1 and the second resistor R2 may be connected to the common voltage sampling sub-circuit 102.

The power supply module 031 may receive a power signal supplied by the main control circuit 01, and generate the common voltage Vcom based on the power signal and resistance values of the first resistor R1 and the second resistor R2. That is, the common voltage Vcom is generated after the first resistor R1 and the second resistor R2 perform voltage division to the power signal. The determining sub-circuit 202 may output an inactive enable signal, which is intended to instruct the common voltage supply circuit 03 to stop supplying a common voltage, to the power supply module 031. That is, the determining sub-circuit 202 may control the power supply module 031 to shut down to make the common voltage supply circuit 03 stop supplying the common voltage.

In summary, this embodiment provides an apparatus for controlling the display module. The apparatus includes the voltage sampling circuit and the data processing circuit. The voltage sampling circuit may acquire the data voltage and the common voltage, and transmit the acquired data voltage and common voltage to the data processing circuit. The data processing circuit may determine, based on the data voltage and the common voltage, whether the liquid crystal molecules are deflected abnormally, and control the main control circuit to restart the liquid crystal molecules are deflected abnormally. Since the main control circuit may return to the normal condition by a restart if abnormal deflection is caused by an abnormality of the main control circuit, abnormal polarity reversal caused by a transient abnormality of the main control circuit may be reliably avoided. Further, the liquid crystal molecules may be prevented from being polarized after continuously operating in the situation of the abnormal deflection.

Figure 8:
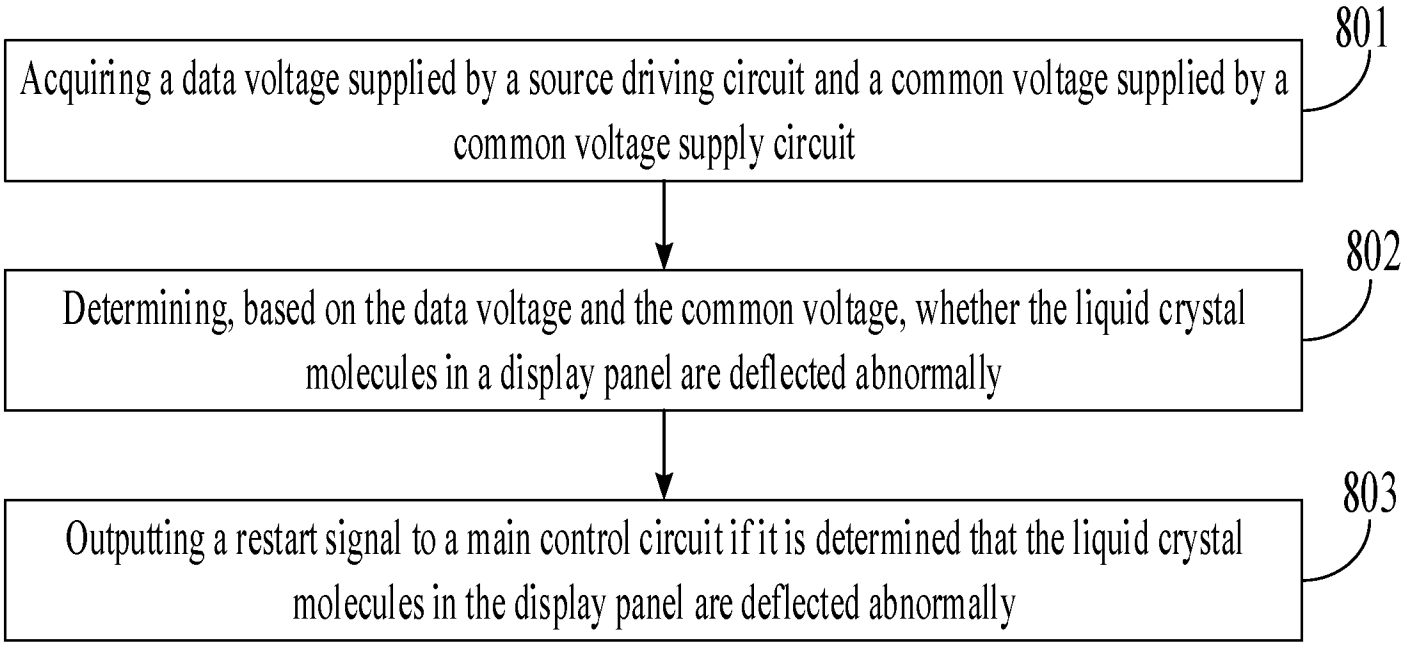
FIG. 8 is a flowchart of a method for controlling a display module in accordance with an embodiment of the present disclosure.

FIG. 8 is a flowchart of a method for controlling a display module in accordance with an embodiment of the present disclosure. As seen with reference to FIGS. 4 to 7, the display module may include a display panel, a main control circuit 01, a source driving circuit 02, and a common voltage supply circuit 03. The method may be applied to the apparatus for controlling the display module according to the above embodiments. As shown in FIG. 8, the method may include the following steps.

In step 801, a data voltage supplied by the source driving circuit and a common voltage supplied by the common voltage supply circuit are acquired.

Optionally, referring to FIG. 4, the apparatus for controlling the display module may include a voltage sampling circuit 10 and a data processing circuit 20. The voltage sampling circuit 10 may acquire a data voltage and a common voltage, and transmit the acquired data voltage and common voltage to the data processing circuit 20.

In step 802, whether liquid crystal molecules in the display panel are deflected abnormally is determined based on the data voltage and the common voltage.

Optionally, the data processing circuit 20 may determine, based on the data voltage and the common voltage, whether the liquid crystal molecules in the display panel are deflected abnormally.

In step 803, a restart signal is output to the main control circuit if it is determined that the liquid crystal molecules in the display panel are deflected abnormally.

The restart signal may be intended to instruct the main control circuit 01 to restart. The data processing circuit 20 may control the main control circuit 01 to restart when it is determined that the liquid crystal molecules are deflected abnormally. The liquid crystal molecules may return to the normal condition by restarting the main control circuit 01 if abnormal deflection is caused by an abnormality of the main control circuit 01.

In summary, this embodiment provides a method for controlling a display module. The apparatus for controlling the display module may acquire the data voltage and the common voltage, determine, based on the data voltage and the common voltage, whether the liquid crystal molecules are deflected abnormally, and control the main control circuit to restart if the liquid crystal molecules are deflected abnormally. Since the main control circuit may return to the normal condition by restart if abnormal deflection is caused by an abnormality of the main control circuit, abnormal polarity reversal caused by a transient abnormality of the main control circuit may be reliably avoided. Further, the liquid crystal molecules will be prevented from being polarized after continuously operating in the situation of abnormal deflection.

Figure 9:
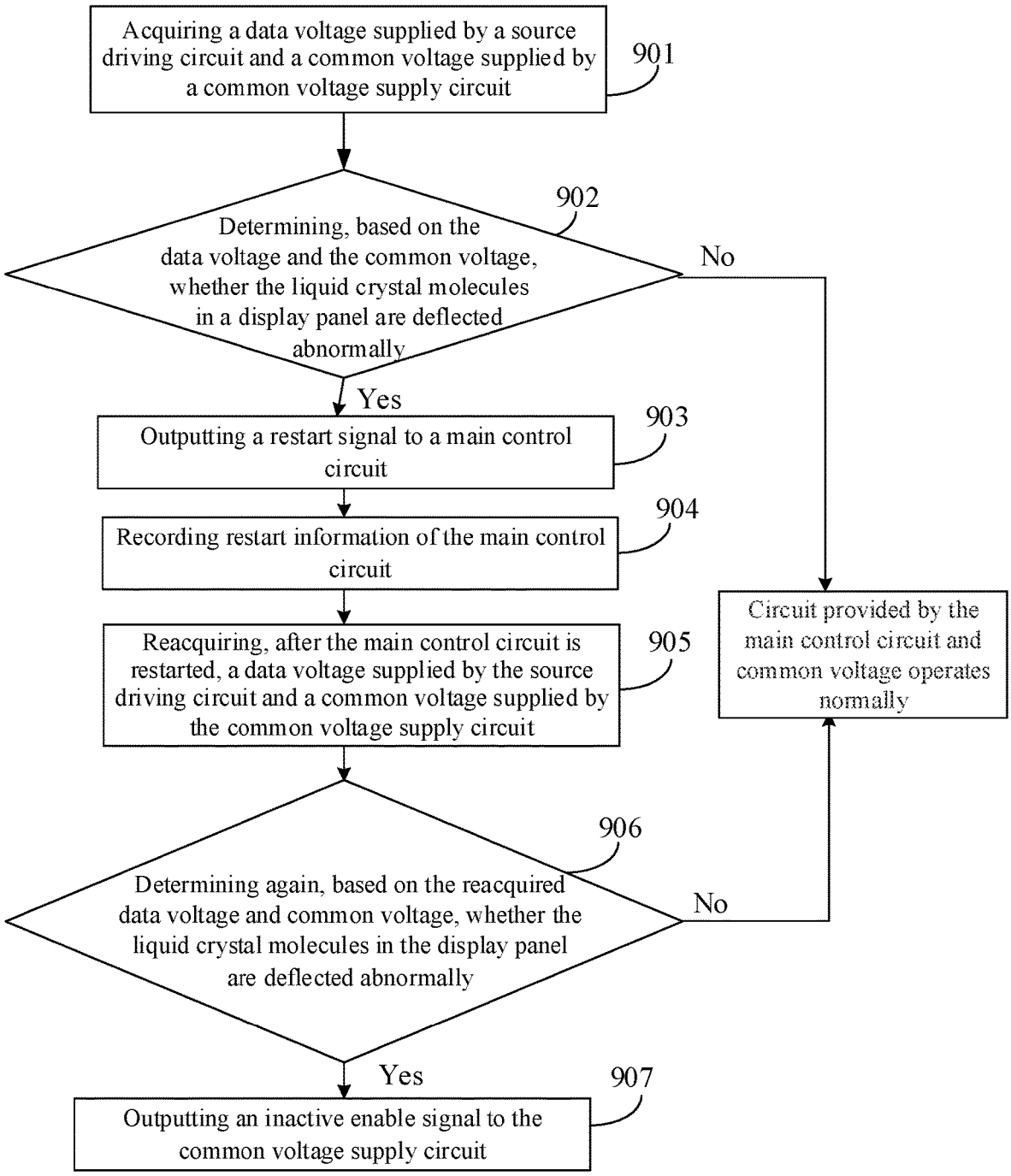
FIG. 9 is a flowchart of another method for controlling a display module in accordance with an embodiment of the present disclosure.

Optionally, the method for controlling the display module according to this embodiment is introduced by taking the apparatus for controlling the display module shown in FIG. 6 or 7 as an example, example, FIG. 9 is a flowchart of another method for controlling a display module in accordance with an embodiment of the present disclosure. As shown in FIG. 9, the method may include the following steps.

In step 901, a data voltage supplied by a source driving circuit and a common voltage supplied by a common voltage supply circuit are acquired.

Optionally, referring to FIG. 6, the voltage sampling circuit 10 may include a data voltage sampling sub-circuit 101 and a common voltage sampling sub-circuit 102. The data voltage sampling sub-circuit 101 may respectively acquire, at a first time instant and a second time instant, a first data voltage and a second data voltage that are supplied by the source driving circuit 02. The common voltage sampling sub-circuit 102 may respectively acquire, at the first time instant and the second time instant, a first common voltage and a second common voltage that are supplied by the common voltage supply circuit 03. The first data voltage and the second data voltage have opposite polarities.

Besides, the data voltage sampling sub-circuit 101 may transmit the acquired first data voltage and second data voltage to the data processing circuit 20, and rhe common voltage sampling sub-circuit 102 may transmit the acquired first common voltage and second common voltage to the data processing circuit 20.

In step 902, whether liquid crystal molecules in a display panel are deflected abnormally is determined based on the data voltage and the common voltage.

Figure 10:
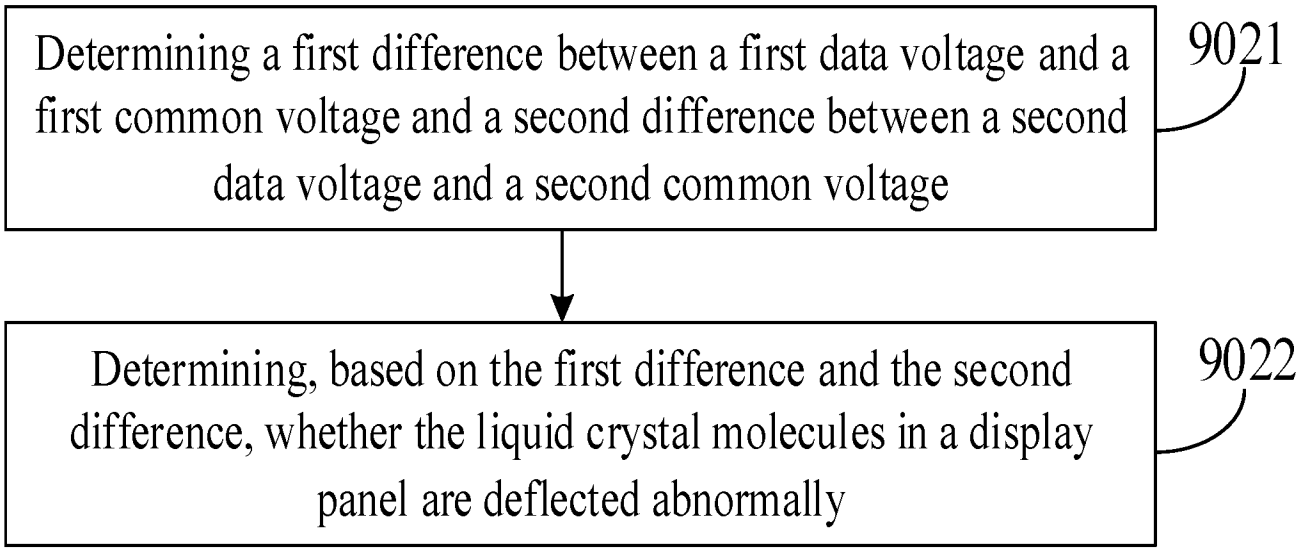
FIG. 10 is a flowchart of a method for determining whether liquid crystal molecules are deflected abnormally in accordance with an embodiment of the present disclosure.

In this embodiment, the data processing circuit 20 may determine, based on the received data voltage and common voltage, whether the liquid crystal molecules in the display panel are deflected abnormally. Optionally, referring to FIG. 6, the data processing circuit 20 may include a data processing sub-circuit 201 and a determining sub-circuit 202, The data voltage sampling sub-circuit 101 may transmit the first data voltage and the second data voltage to the data processing sub-circuit 201, and the common voltage sampling sub-circuit 102 may transmit the first common voltage and the second common voltage to the data processing sub-circuit 201, FIG. 10 is a flowchart of a method for determining whether liquid crystal molecules are deflected abnormally in accordance with an embodiment of the present disclosure. As shown in FIG. 10, the method may include the following steps.

In step 9021, a first difference between a first data voltage and a first common voltage and a second difference between a second data voltage and a second common voltage, is determined.

Optionally, the data processing sub-circuit 201 may calculate, by an internal processor thereof, the first difference between the received first data voltage and first common voltage, and the second difference between the received second data voltage and second common voltage, and transmit the determined first difference and second difference to the determining sub-circuit 202.

For example, it is assumed that the first data voltage received by the data processing sub-circuit 201 is 6 V, the second data voltage is −6 V, and both of the first common voltage and the second common voltage are 1 V. Then, the data processing sub-circuit 201 may calculate that the first difference $\Delta V1$ between the first data voltage and the first common voltage is 5 V, and the second difference $\Delta V2$ between the second data voltage and the second common voltage is 7 V.

In step 9022, whether liquid crystal molecules in a display panel are deflected abnormally is determined based on the first difference and the second difference.

Optionally, the determining sub-circuit 202 may first determine a difference between the first difference and the second difference after receiving the first difference and the second difference. If the difference between the first difference and the second difference is greater than a difference threshold, the determining sub-circuit 202 may determine that the liquid crystal molecules in the display panel are deflected abnormally; and if the difference between the first difference and the second difference is less than or equal to the difference threshold, the determining sub-circuit 202 may determine that the liquid crystal molecules in the display panel are deflected normally. Optionally, the difference threshold may be a fixed value preset in the determining sub-circuit 202. For example, the difference threshold may be 0.

For example, it is assumed that the difference threshold is 0, the first difference $\Delta V1$ is 5 V, and the second difference ΔV2 is 7 V. Then, the difference between the first difference ΔV1 and the second difference ΔV2, calculated by the determining sub-circuit 202, is 2V. Since the difference 2V is greater than the difference threshold 0, the determining sub-circuit 202 may determine that the liquid crystal molecules are deflected abnormally.

In step 903, a restart signal is output to a main control circuit if it is determined that the liquid crystal molecules in the display panel are deflected abnormally.

The restart signal may be intended to instruct the main control circuit 01 to restart. In this embodiment, the determining sub-circuit 202 may firstly output the restart signal, which is intended to instruct the main control circuit 01 to restart, to the main control circuit 01 when determining for the first time that the liquid crystal molecules are deflected abnormally, so as to control the main control circuit 01 to restart. The liquid crystal molecules may return to the normal condition by controlling the main control circuit 01 to restart if abnormal deflection is caused by an abnormality of the main control circuit 01.

Figure 11:
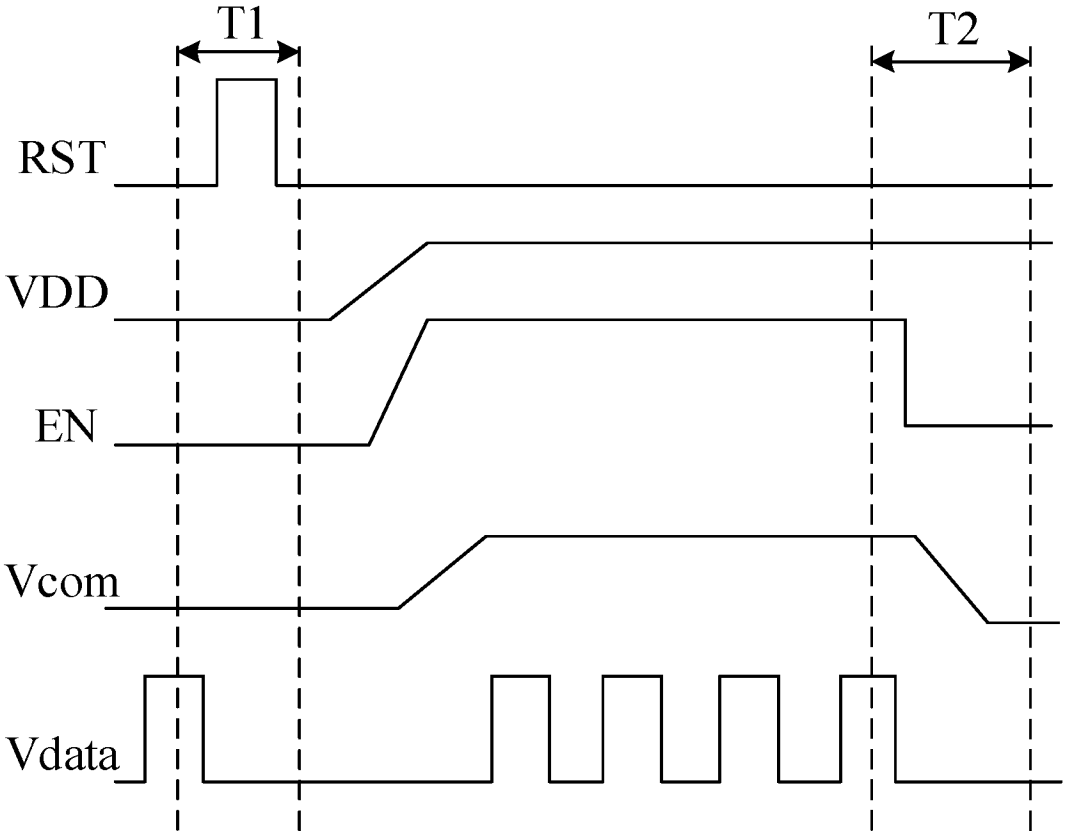
FIG. 11 is a sequence chart of signals in accordance with an embodiment of the present disclosure.

For example, FIG. 11 is a sequence chart of signals of a display module in accordance with an embodiment of the present disclosure. Referring to FIG. 11, when it is determined for the first time that the liquid crystal molecules are deflected abnormally, that is, in phase T1 as shown in FIG. 11, the determining sub-circuit 202 may output an RST signal at a second potential, namely, the restart signal, to the main control circuit 01, and the main control circuit 01 is restarted. Since the main control circuit 01 is restarted, in phase T1 as shown in FIG. 11, the potential of the data signal (i.e., the data voltage Vdata) supplied by the main control circuit 01 to the source driving circuit 02 jumps from the second potential to the first potential, a potential of the power signal VDD supplied to the common voltage supply circuit 03 is the first potential, and further, a potential of the common voltage Vcom supplied by the common voltage supply circuit 03 is the first potential. Moreover, in phase T1, a potential of an EN signal supplied by the determining sub-circuit 202 to the power supply module 031 may also be the first potential. That is, the determining sub-circuit 202 may provide an inactive enable signal to the power supply module 031 to control the power supply module 031 to be turned off.

Optionally, referring to FIG. 9, the main control circuit 01 and the common voltage supply circuit 03 work normally if it is determined that the liquid crystal molecules are deflected normally. That is, the determining sub-circuit 202 may not output the restart signal to the main control circuit 01.

In step 904, restart information of the main control circuit is recorded.

In this embodiment, the data processing circuit 20 may further record the restart information of the main control circuit 01 after the main control circuit 01 is restarted. By recording the restart information, it is convenient for an operator to locate the causes to abnormal deflection of the liquid crystal molecules with a follow-up reference to the restart information, such that the causes to abnormal deflection are quickly identified.

In step 905, after the main control circuit is restarted, a data voltage supplied by, the source driving circuit and a common voltage supplied by the common voltage supply circuit are reacquired.

Optionally, since the liquid crystal molecules are still deflected abnormally after the main control circuit 01 is restarted, it may be caused by abnormalities of internal circuit devices of the display panel. Therefore, in order to further prevent the liquid crystal molecules from being polarized after continuously operating in the situation of abnormal deflection, after the main control circuit 01 is restarted, the data voltage sampling sub-circuit 101 may reacquire the data voltage supplied by the source driving circuit 02 and transmit the reacquired data voltage to the data processing circuit 20. In addition, the common voltage sampling sub-circuit 102 may reacquire the common voltage supplied by the common voltage supply circuit 03, and transmit the reacquired common voltage to the data processing circuit 20. A reference may be made to the description of step 901 for methods for acquiring the data voltage and the common voltage, which will not be repeated herein.

In step 906, whether the liquid crystal molecules in the display panel are deflected abnormally is determined again based on the reacquired data voltage and common voltage.

Further, the data processing circuit 20 may determine again, based on the data voltage and the common voltage that are reacquired by the voltage sampling circuit 10 after the main control circuit 01 is restarted, whether the liquid crystal molecules in the display panel are deflected abnormally. A reference may be made to the description of step 902 for a method for determining whether the liquid crystal molecules are deflected abnormally, which will not be repeated herein.

In step 907, an inactive enable signal is output to the common voltage supply circuit if it is determined again that the liquid crystal molecules in the display panel are deflected abnormally.

The inactive enable signal may be intended to instruct the common voltage supply circuit 03 to stop supplying a common voltage. If the liquid crystal molecules are still deflected abnormally after the main control circuit 01 is restarted, it may be caused by abnormalities of rear-end circuit components of the display panel. Therefore, by controlling the common voltage supply circuit 03 to stop supplying the common voltage when it is determined again that the liquid crystal molecules are deflected abnormally, the liquid crystal molecules may be effectively, prevented from being polarized after continuously operating in the situation of abnormal deflection. That is, the liquid crystal molecules may be prevent from being polarized due to long-time abnormally lighting.

For example, referring to FIG. 11, after the main control circuit 01 is restarted, that is, between phase T1 and phase T2, the potential of the EN signal supplied by the determining sub-circuit 202 to the common voltage supply circuit 03 jumps to the second potential. At this time, the determining sub-circuit 202 provides an enable signal to the common voltage supply circuit 03. Correspondingly, the potential of the common voltage Vcom supplied by the common voltage supply circuit 03 also jumps to the second potential. That is, the common voltage supply circuit 03 operates normally. After it is determined for the second time that the liquid crystal molecules are deflected abnormally, namely, in phase T2 as shown in FIG. 11, the determining sub-circuit 202 adjusts the potential of the EN signal from the second potential to the first potential. At this time, the determining sub-circuit 202 provides the inactive enable signal to the common voltage supply circuit 03. Correspondingly, referring to FIG. 11, the potential of the common voltage Vcom supplied by the common voltage supply circuit 03 also jumps from the second potential to the first potential. That is, the common voltage supply circuit 03 stops supplying the common voltage.

Also, referring to FIG. 11, after the main control circuit 01 is restarted, namely, after phase T1, the potential of the RST signal jumps to the first potential. That is, the determining sub-circuit 202 stops supplying the restart signal to the main control circuit 01. At this time, the main control circuit 01 operates normally. Correspondingly, the potential of the power signal VDD output by the main control circuit 01 to the common voltage supply circuit 03 also jumps to the first potential.

Similarly, referring to FIG. 9, if the liquid crystal molecules are deflected normally, both of the main control circuit 01 and the common voltage supply circuit 03 may work normally. That is, the determining sub-circuit 202 will not output the inactive enable signal to the common voltage supply circuit 03.

Optionally, after step 906, if it is determined again that the liquid crystal molecules in the display panel are deflected abnormally, a shutdown signal intended to instruct the main control circuit 01 to be shut down may be output to the main control circuit 01.

It should be noted that the sequence of the steps in the method for controlling the display module, according to this embodiment, may be adjusted appropriately, and the steps may be deleted or added according to the situation. For example, steps 904 and 905 may be performed simultaneously. Within the technical scope disclosed by the present disclosure, any variations of the method easily derived by those skilled in the art shall fall within the protection scope of the present disclosure, and will not be repeated herein.

In summary, this embodiment provides a method for controlling the display module. The apparatus for controlling the display module may acquire the data voltage and the common voltage, determine, based on the data voltage and the common voltage, whether the liquid crystal molecules are deflected abnormally, and control the main control circuit to restart if the liquid crystal molecules are deflected abnormally. Since the main control circuit may return to the normal condition by restart if abnormal deflection is caused by an abnormality of the main control circuit, abnormal polarity reversal caused by a transient abnormality of the main control circuit may be reliably avoided. Further, the liquid crystal molecules will be prevented from being polarized after continuously operating in the situation of abnormal deflection.

Optionally, an embodiment of the present disclosure further provides a display device. Referring to FIGS. 4 to 7, the display device may include a display module and the apparatus 00 for controlling the display module according to the above embodiments. The apparatus 00 for controlling the display module may be connected to the display module. As shown in FIGS. 4 to 7, the display module includes a main control circuit 01, a source driving circuit 02, and a common voltage supply circuit 03. The apparatus 00 is connected to the main control circuit 01, the source driving circuit 02, and the common voltage supply circuit 03 respectively.

Optionally, the display device may be any product or component having a display function, such as a liquid crystal display device, electronic paper, a mobile phone, a tablet computer, a television, a display, a notebook computer, or a digital photo frame.

Optionally, an embodiment of the present disclosure further provides an apparatus for use in controlling a display module. The apparatus may include a processor and a memory. The memory stores at least one instruction therein, which, when being loaded and executed by the processor, may enable the processor to perform the method for controlling the display module as shown in FIG. 8 or FIG. 9.

Optionally, an embodiment of the present disclosure further provides a non-volatile storage medium. The non-volatile storage medium stores at least one instruction therein. When the non-volatile storage medium runs on a processor, the processor may be enabled to perform the method for controlling the display module as shown in FIG. 8 or FIG. 9.

Those skilled in the art would clearly understand that, for the convenience and brevity of description, references may be made to corresponding processes in the foregoing method embodiments for specific operating processes of the display module, the apparatus for controlling the display module, and all circuits and sub-circuits described above, which will not be repeated herein.

Described above are merely exemplary embodiments of the present disclosure, and are not intended to limit the present disclosure. Within the spirit and principles of the disclosure, any modifications, equivalent substitutions, improvements, or the like, are within the protection scope of the present disclosure.

What is claimed is:

1. An apparatus for controlling a display module, the display module comprising a display panel, a main control circuit, a source driving circuit, and a common voltage supply circuit; and the apparatus comprising a voltage sampling circuit and a data processing circuit; wherein the voltage sampling circuit is connected to the source driving circuit, the common voltage supply circuit, and the data processing circuit respectively, and configured to acquire a data voltage supplied by the source driving circuit, and a common voltage supplied by the common voltage supply circuit, and transmit the data voltage and the common voltage to the data processing circuit; and the data processing circuit is further connected to the main control circuit and the common voltage supply circuit, and configured to determine, based on the data voltage and the common voltage, whether liquid crystal molecules in the display panel are deflected abnormally; and the data processing circuit is further configured to output a restart signal, which is configured to instruct the main control circuit to restart, to the main control circuit when determining for a first time that the liquid crystal molecules are deflected abnormally, so as to control the main control circuit to restart; output an inactive enable signal, which is configured to instruct the common voltage supply circuit to stop supplying a common voltage, to the common voltage supply circuit when determining for a second time that the liquid crystal molecules are deflected abnormally, so as to control the common voltage supply circuit to stop outputting; and output a shutdown signal to the main control circuit when determining for a third time that the liquid crystal molecules in the display panel are deflected abnormally, the shutdown signal being intended to instruct the main control circuit to be shut down.

2. The apparatus according to claim 1, wherein the voltage sampling circuit comprises a data voltage sampling sub-circuit and a common voltage sampling sub-circuit; wherein the data voltage sampling sub-circuit is connected to the source driving circuit and a data processing sub-circuit respectively, and configured to acquire, at a first time instant, a first data voltage supplied by the source driving circuit, acquire, at a second time instant, a second data voltage supplied by the source driving circuit, and transmit the first data voltage and the second data voltage to the data processing sub-circuit, the first data voltage and the second data voltage having opposite polarities; and the common voltage sampling sub-circuit is connected to the common voltage supply circuit and the data processing sub-circuit respectively, and configured to acquire, at the first time instant, a first common voltage supplied by the common voltage supply circuit, to acquire, at the second time instant, a second common voltage supplied by the common voltage supply circuit, and transmit the first common voltage and the second common voltage to the data processing sub-circuit.

3. The apparatus according to claim 2, wherein the data processing circuit comprises the data processing sub-circuit and a determining sub-circuit; wherein the data processing sub-circuit is further connected to the determining sub-circuit, and configured to determine a first difference between the first data voltage and the first common voltage and a second difference between the second data voltage and the second common voltage, and transmit the first difference and the second difference to the determining sub-circuit; and the determining sub-circuit is configured to determine, based on the first difference and the second difference, whether the liquid crystal molecules in the display panel are deflected abnormally.

4. The apparatus according to claim 3, wherein the determining sub-circuit is configured to:

determine that the liquid crystal molecules in the display panel are deflected abnormally if a difference between the first difference and the second difference is greater than a difference threshold; or determine that the liquid crystal molecules in the display panel are deflected normally if the difference between the first difference and the second difference is less than or equal to the difference threshold.

5. The apparatus according to claim 1, wherein the voltage sampling circuit is configured to acquire, based on a target sampling frequency, a data voltage supplied by the source driving circuit and a common voltage supplied by the common voltage supply circuit, the target sampling frequency being less than or equal to a polarity reversal frequency of the data voltage.

6. The apparatus according to claim 1, wherein determining for the second time that the liquid crystal molecules are deflected abnormally comprises:

reacquiring, by the voltage sampling circuit, after the main control circuit is restarted, a data voltage supplied by the source driving circuit and a common voltage supplied by the common voltage supply circuit, and transmitting, by the voltage sampling circuit, the reacquired data voltage and common voltage to the data processing circuit; and determining again, by the data processing circuit, based on the reacquired data voltage and common voltage, whether the liquid crystal molecules in the display panel are deflected abnormally.

7. The apparatus according to claim 1, wherein the data processing circuit is further configured to record restart information of the main control circuit after outputting the restart signal to the main control circuit.

8. The apparatus according to claim 1, wherein both of the voltage sampling circuit and the data processing circuit are processing chips.

9. The apparatus according to claim 2, wherein both of the voltage sampling circuit and the data processing circuit are processing chips; the voltage sampling circuit is configured to acquire, based on a target sampling frequency, a data voltage supplied by the source driving circuit and a common voltage supplied by the common voltage supply circuit, the target sampling frequency being less than or equal to a polarity reversal frequency of the data voltage;

determining for the second time that the liquid crystal molecules are deflected abnormally comprises:

reacquiring, by the voltage sampling circuit, after the main control circuit is restarted, a data voltage supplied by the source driving circuit and a common voltage supplied by the common voltage supply circuit, and transmitting the reacquired data voltage and common voltage to the data processing circuit; and determining again, by the data processing circuit, based on the reacquired data voltage and common voltage, whether the liquid crystal molecules in the display panel are deflected abnormally;

the data processing circuit is further configured to record restart information of the main control circuit after outputting the restart signal to the main control circuit; and the data processing circuit comprises a data processing sub-circuit and a determining sub-circuit; wherein the data processing sub-circuit is further connected to the determining sub-circuit, and configured to determine a first difference between the first data voltage and the first common voltage and a second difference between the second data voltage and the second common voltage, and transmit the first difference value and the second difference value to the determining sub-circuit; and the determining sub-circuit is configured to determine that the liquid crystal molecules in the display panel are deflected abnormally if a difference between the first difference and the second difference is greater than a difference threshold, and determine that the liquid crystal molecules in the display panel are deflected normally if the difference between the first difference and the second difference is less than or equal to the difference threshold.

10. A method for controlling a display module, the display module comprising a display panel, a main control circuit, a source driving circuit and a common voltage supply circuit; and the method comprising:

acquiring a data voltage supplied by the source driving circuit, and a common voltage supplied by the common voltage supply circuit;

determining, based on the data voltage and the common voltage, whether liquid crystal molecules in the display panel are deflected abnormally; and outputting a restart signal, which is configured to instruct the main control circuit to restart, to the main control circuit when determining for a first time that the liquid crystal molecules are deflected abnormally, so as to control the main control circuit to restart; outputting an inactive enable signal, which is configured to instruct the common voltage supply circuit to stop supplying a common voltage, to the common voltage supply circuit when determining for a second time that the liquid crystal molecules are deflected abnormally, so as to control the common voltage supply circuit to stop outputting; and outputting a shutdown signal to the main control circuit when determining for a third time that the liquid crystal molecules in the display panel are deflected abnormally, the shutdown signal being intended to instruct the main control circuit to be shut down.

11. The method according to claim 10, wherein acquiring the data voltage supplied by the source driving circuit, and the common voltage supplied by the common voltage supply circuit comprises:

acquiring, at a first time instant, a first data voltage supplied by the source driving circuit and a first common voltage supplied by the common voltage supply circuit; and acquiring, at a second time instant, a second data voltage supplied by the source driving circuit and a second common voltage supplied by the common voltage supply circuit, the first data voltage and the second data voltage having opposite polarities; and determining, based on the data voltage and the common voltage, whether the liquid crystal molecules in the display panel are deflected abnormally comprises:

determining a first difference between the first data voltage and the first common voltage and a second difference between the second data voltage and the second common voltage; and determining, based on the first difference and the second difference, whether the liquid crystal molecules in the display panel are deflected abnormally.

12. The method according to claim 11, wherein determining, based on the data voltage and the common voltage, whether the liquid crystal molecules in the display panel are deflected abnormally comprises:

determining that the liquid crystal molecules in the display panel are deflected abnormally if a difference between the first difference and the second difference is greater than a difference threshold; or determining that the liquid crystal molecules in the display panel are deflected normally if the difference between the first difference and the second difference is less than or equal to the difference threshold.

13. The method according to claim 10, wherein acquiring the data voltage supplied by the source driving circuit, and the common voltage supplied by the common voltage supply circuit comprises:

acquiring, based on a target sampling frequency, a data voltage supplied by the source driving circuit and a common voltage supplied by the common voltage supply circuit;

wherein the target sampling frequency is less than or equal to a polarity reversal frequency of the data voltage.

14. The method according to claim 10, wherein after outputting the restart signal to the main control circuit, the method further comprises:

reacquiring, by the voltage sampling circuit, after the main control circuit is restarted, a data voltage supplied by the source driving circuit and a common voltage supplied by the common voltage supply circuit;

determining again, by the data processing circuit, based on the reacquired data voltage and common voltage, whether the liquid crystal molecules in the display panel are deflected abnormally.

15. The method according to claim 10, wherein after outputting the restart signal to the main control circuit, the method further comprises: recording restart information of the main control circuit.

16. An apparatus for use in controlling a display module, comprising a processor and a memory; wherein the memory stores at least one instruction therein, which, when being loaded and executed by the processor, enables the processor to perform the method for controlling the display module as defined in claim 10.

17. A non-transitory non-volatile storage medium, storing at least one instruction therein; wherein when the non-volatile storage medium runs on a processor, the processor is enabled to perform the method for controlling the display module as defined in claim 10.

18. A display device, comprising a display module and an apparatus for controlling the display module, the display module comprising a display panel, a main control circuit, a source driving circuit, and a common voltage supply circuit, and the apparatus for controlling the display module comprising a voltage sampling circuit and a data processing circuit; wherein the voltage sampling circuit is connected to the source driving circuit, the common voltage supply circuit, and the data processing circuit respectively, and configured to acquire a data voltage supplied by the source driving circuit, and a common voltage supplied by the common voltage supply circuit, and transmit the data voltage and the common voltage to the data processing circuit; and the data processing circuit is further connected to the main control circuit and the common voltage supply circuit, and configured to determine, based on the data voltage and the common voltage, whether liquid crystal molecules in the display panel are deflected abnormally; and the data processing circuit is further configured to output a restart signal, which is configured to instruct the main control circuit to restart, to the main control circuit when determining for a first time that the liquid crystal molecules are deflected abnormally, so as to control the main control circuit to restart; output an inactive enable signal, which is configured to instruct the common voltage supply circuit to stop supplying a common voltage, to the common voltage supply circuit when determining for a second time that the liquid crystal molecules are deflected abnormally, so as to control the common voltage supply circuit to stop outputting; and output a shutdown signal to the main control circuit when determining for a third time that the liquid crystal molecules in the display panel are deflected abnormally, the shutdown signal being intended to instruct the main control circuit to be shut down.

* * * * *